US006203444B1

(12) United States Patent
McRae

(10) Patent No.: US 6,203,444 B1
(45) Date of Patent: Mar. 20, 2001

(54) GOLF PUTTER HAVING A NEGATIVELY CONTOURED BALL-STRIKING SURFACE

(76) Inventor: Brian J. McRae, 28059 Kendallwood, Farmington Hills, MI (US) 48334

( * ) Notice: Subject to any disclaimer, the term of this patent is extended or adjusted under 35 U.S.C. 154(b) by 0 days.

(21) Appl. No.: 09/363,809

(22) Filed: Jul. 3, 1999

(51) Int. Cl.[7] ..... A63B 69/36; A63B 53/04
(52) U.S. Cl. ..... 473/244; 473/330
(58) Field of Search ..... 473/324, 330, 473/329, 342, 325, 288, 244

(56) References Cited

U.S. PATENT DOCUMENTS 1,674,173 * 6/1928 Haupt .
3,368,812 * 2/1968 Baldwin .
4,113,249 * 9/1978 Beery .
4,290,606 * 9/1981 Maxwell .
5,064,197 * 11/1991 Eddy .
5,316,304 * 5/1994 Yost .
5,464,212 * 11/1995 Cook .
5,632,693 * 5/1997 Painter .
5,643,109 * 7/1997 Rose .

FOREIGN PATENT DOCUMENTS

14313 * 10/1904 (GB) .

* cited by examiner

*Primary Examiner*—Sebastiano Passaniti

(57) ABSTRACT

A golf putter can be provided with a concave ball-striking surface that causes the golf ball to move toward a target point on the ball-striker axis when the ball contact is. offset from the ball-striker axis. The contour of the ball-striking surface can be varied to adapt the putter head to different target distances.

10 Claims, 3 Drawing Sheets

GOLF PUTTER HAVING A NEGATIVELY CONTOURED BALL-STRIKING SURFACE

BACKGROUND AND SUMMARY OF THE INVENTION

This invention relates to a golf putter that includes a putter head having a contoured ball-striking surface. An aim of the invention is to increase the accuracy of the golf putting stroke.

Golf putters commonly have flat ball-striking surfaces designed to propel the golf ball along a path normal to the plane of the ball striking surface. When the ball is struck at a point offset from the ball-striker axis there can be a slight error in the path taken by the ball. In some cases this error can be sufficient to cause the ball to miss the target hole (cup). The present invention relates to a golf putter head having a contoured ball-striking surface designed to minimize errors caused when the ball is struck at a point offset from the ball-striker axis.

Golf putters representative of the prior art shown in U.S. Pat. No. 4,113,249 issued to P. Berry, U.S. Pat. No. 5,464,212 issued to T. Cook, and U.S. pat. No. 5,643,109 issued to A. Rose. These patents show golf putters having flat ball-striking surfaces extending normal to a ball striking axis located midway between the toe and heel edges of the putter head.

With the conventional putter the putter head is swung along the intended path of the golf ball; this intended path is visualized by the golfer as a vertical plane extending through the ball-striker axis, i.e. an axis located midway between the heel and toe edges of the putter head. Should the putter head strike the ball at any point offset from the ball-striker axis the ball will take a path slightly offset from the intended path. In some cases such an offset in the actual ball path can be sufficient to cause the ball to miss the target point, i.e. the hole (or cup).

The present invention relates to a golf putter head, wherein the ball-striking surface is contoured so that if the ball is struck at a point offset from the ball-striker axis the ball will roll toward a distant point along said axis, rather than rolling parallel to said axis. As a result, the ball will reach the target point on a relatively consistent basis.

In certain forms of the invention the contour of the ball-striking surface is adjustable in accordance with different target distances. Thus, the contour of the ball-striking surface for a three foot putt will be different than the corresponding contour for a seven foot putt.

Specific features of the invention will be apparent from the attached drawings and description of illustrative embodiments of the invention.

DESCRIPTION OF PREFERRED EMBODIMENTS OF THE INVENTION

FIG. 1 schematically shows a conventional golf club during the process of rolling a golf ball toward a distant target hole.

FIG. 5 shows the putter adapted for use in rolling a golf ball toward a distant target, e.g. a target greater than ten feet away from the golf ball.

FIG. 6 shows the putter adapted for use in rolling a golf ball toward a target that is an intermediate distance from the golf ball, e.g. a target distance of about six feet.

FIG. 7 shows the putter adapted for use in rolling a golf ball toward a target that is a relatively short distance away from the golf ball, e.g. a distance of about three feet.

FIG. 8 is a perspective view of a putter head used interchangeably with the putter inserts shown in FIGS. 5 through 7.

DESCRIPTION OF A PREFERRED EMBODIMENT OF THE INVENTION

Figure 1:
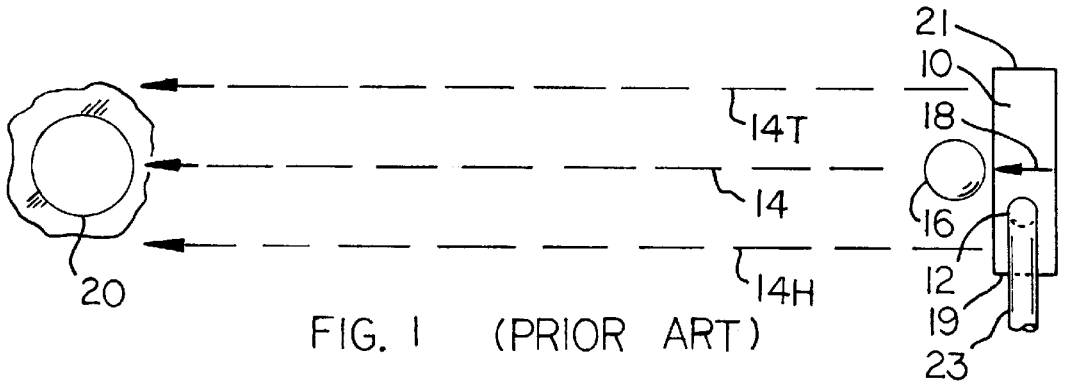
FIG. 1 (PRIOR ART)

FIG. 1 shows a conventional golf putter head 10 having a flat ball-striking surface 12 extending normal to a ball-striking axis 18 located midway between the heel edge 19 and the toe edge 21 of the putter head. The putter includes a shaft 23 extending upwardly from head 10, whereby the golfer is enabled to swing the putter head along a desired path so as to strike a golf ball 16, thereby advancing the ball toward the target hole 20.

If the club head 10 is swung along the ball-striker axis 18 the golf ball 16 will move along pathline 14 so as to reach the target hole (cup) 20. However, if the golfer should inadvertently swing the putter head 10 so that surface 12 contacts the golf ball near the heel edge 19 the ball may travel along pathline 14-H so as to miss target hole 20 (assuming the putter head is swung on an arc that is parallel to ball-striker axis 18).

Should the golfer inadvertently swing the putter head 10 so that surface 12 contacts the golf ball near the toe edge 21, the ball may travel along pathline 14-T so as to miss the target hole 20. With the conventional putter head, putter accuracy is dependent partly on hitting the golf ball at a point on the ball-striker axis 18 (usually considered to be the midpoint between heel edge 19 and toe edge 21). If the ball is struck at a point on surface 12 offset from the ball-striker axis, the accuracy of the putt can be adversely affected, particularly for short distance putts less than six feet in length.

The typical golf cup 20 has a diameter of about four and one quarter inch. The typical golf ball has a diameter slightly less than one and three quarter inch. The typical golf putter head is dimensioned so that the distance between the heel edge 19 and the toe edge 21 is about five inches.

Figure 2:
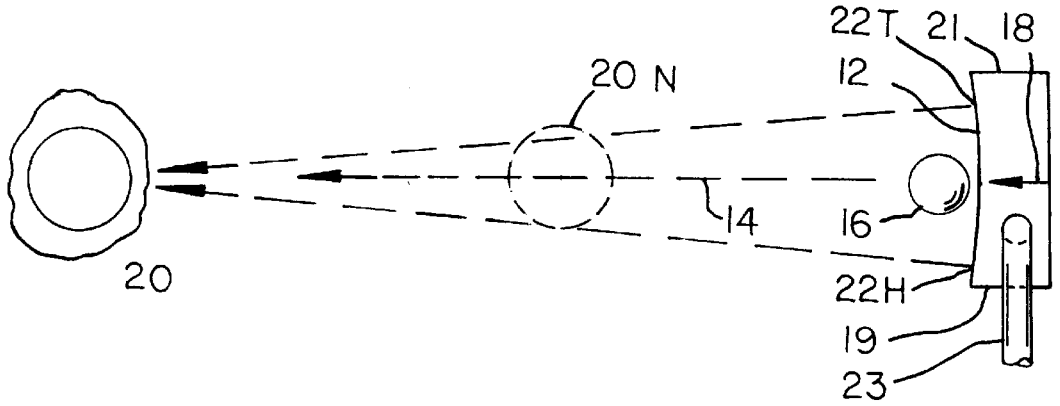
FIG. 2 is a view taken in the same direction as FIG. 1, but showing a golf club of the present invention.

FIG. 2 shows a putter head 10 embodying features of the present invention. Ball-striking surface 12 has a concave contour measured in the horizontal plane. Surface 12 can be flat (linear) in the vertical plane. At the midpoint of surface 12 (in the horizontal plane) the surface extends normal to ball-striker axis 18. If the golfer swings the putter head in the desired arc so that surface 12 strikes the ball along ball-striker axis 18, the ball will travel along path 14 so as to reach the target hole 20; the ball-striking action is the same as employed with the FIG. 1 putter.

The concave contour on surface 12 is symmetrical relative to ball-striker axis 18, so that surface 12 has the same angulation when measured in opposite directions from the ball-striker axis. For example. the surface 12 angulation at point 22-T is numerically the same as the surface angulation at point 22-H. Concave surface 12 comprises two mirror image half sections, measured in opposite directions from ball-striker axis 18.

Contoured surface 12 is acutely angled so that when the putter head is swung along any plane parallel to ball-striker axis 18 the golf ball 12 will roll toward target 20, even when the ball is struck at points offset from the ball-striker axis 18. At any point along ball-striking surface 12 the respective surface segment lies in a plane normal to the intended path passing through the center of target hole 20. The contoured surface 12 causes the golf ball to travel toward the target, even when the ball is struck at points offset from ball-striker axis 18. A further advantage of the contoured ball-striking surface is that the contour tends to compensate for any tendency of the club shaft to twist in the players hands when the ball is struck near the heel or toe of the club head.

Contoured surface 12 (FIG. 2) is designed so that the golf ball is targeted at a specific point along the central pathline 14, e.g. a point three feet from the initial ball location. However, a putter having a specific contoured surface 12 can be successfully used for target distances reasonably close to the specific distance for which the putter ball-striking surface is designed. For example, the target hole can be located nearer the initial ball location, as shown by dashed line 20-N in FIG. 2; the ball will still pass across a part of the target hole. Similarly, the target distance can be somewhat greater than the designed target distance, while still providing successful results. If the golfer consistently strikes the ball on the ball-striker axis, the contoured surface putter head can be used for any target distance.

Figure 5:
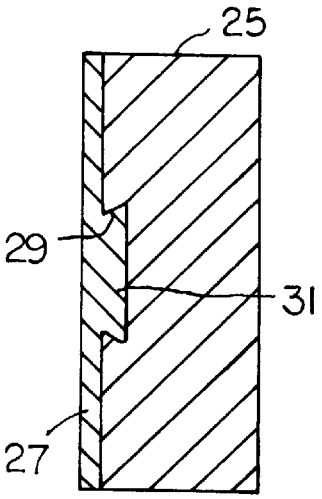
FIGS. 5 through 8 illustrate another golf putter assembly embodying the invention.
Figure 6:
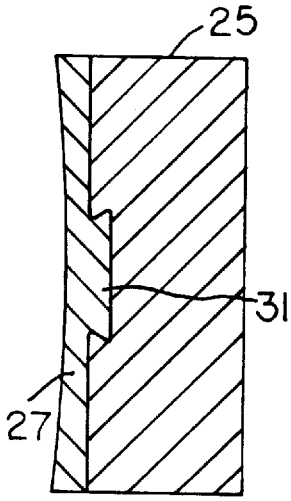
Figure 7:
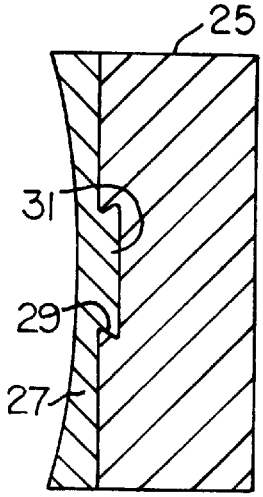
Figure 8:
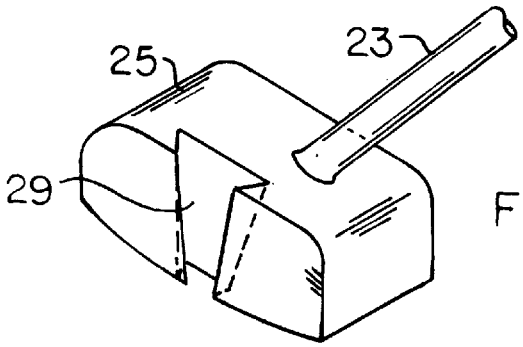

FIGS. 5 through 8 show a putter head assembly wherein the contour on the ball-striker surface can be varied to suit different target distances. The putter head assembly comprises a main head element 25 attached to club shaft 23, and plural face plates 27 selectively attachable to the front surface of head element 25. Head element 25 has a dovetail slot 29 in its front surface, while each face plate 27 has a mating projection 31 in its rear surface. Due to the interlocking fit between each projection 31 and dovetail slot 29, each face plate can be mounted on head element 25, as shown in FIGS. 5, 6 and 7.

The face plate shown in FIG. 5 has a flat (linear) ball-striking surface 12. The FIG. 5 putter head assembly is designed for use with relatively great target distances, e.g. target distances greater than about ten feet.

The face plate shown in FIG. 6 has a slightly curved (large radius) ball-striking surface 12. The FIG. 6 putter head assembly is designed for use when the target is an intermediate distance from the initial ball location, e.g. a distance of about six feet.

The face plate shown in FIG. 7 has a more pronounced curved ball-striking surface 12 (i.e. a smaller radius of curvature). The FIG. 7 putter head assembly is designed for use when the target is relatively close to the initial ball location, e.g. a distance of about three feet.

As noted above, in connection with the description of the FIG. 2 putter head construction, any given ball-striking surface contour can be used for a reasonable range of target distances, less than or greater than the design target distance.

Figure 3:
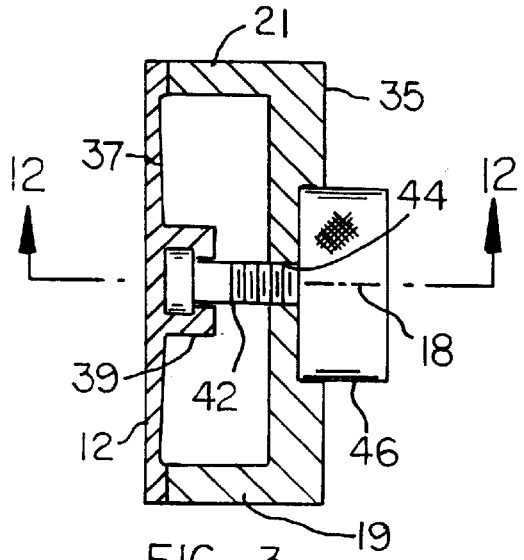
FIG. 3 is a sectional view taken through a golf putter embodying the invention.
Figure 4:
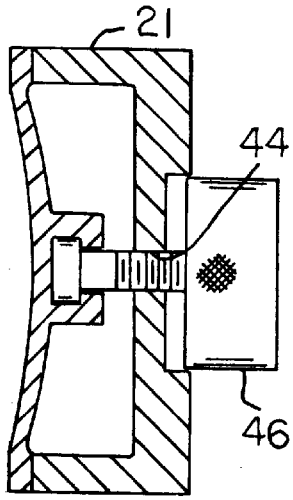
FIG. 4 is a view taken in the same direction as FIG. 3, but showing the putter ball-striking surface in a different condition of adjustment.
Figure 12:
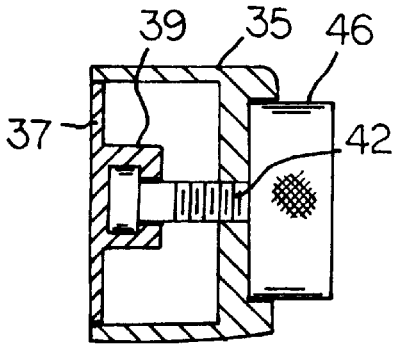
FIG. 12 is a sectional view taken on line 12—12 in FIG. 3.

FIGS. 3, 4, and 12 show a further putter head design embodying features of the invention. In this case the putter head assembly comprises a head element 35 attached to a club shaft (not shown), and a flexible ball-striker wall 37 mounted on the front surface of head element 35. The interior surface of flexible wall 37 carries a socket structure 39 that forms a swivel mounting for a cylindrical enlargement 41 on the front end of screw 42. Screw 42 is located on the ball-striker axis 18.

Screw 42 is in mesh with a threaded hole 44 in the rear wall of head element 35, whereby manual rotation of screw 42 can be used to produce a flexing motion of wall 37. A manual knob 46 on the rear end of the screw can be used to achieve the desired screw rotation.

FIGS. 3 and 4 show two different adjusted positions of flexible wall 37. As shown in FIG. 3, wall 37 provides a flat (linear) ball-striker surface 12 extending normal to the ball-striker axis 18. The FIG. 3 putter head configuration is used for relatively long target distances, e.g. target distances in excess of ten feet.

As shown in FIG. 4, wall 37 is flexed to provide a concave ball-striking surface 12. The FIG. 4 putter head configuration is used when the target hole is a relatively short distance from the initial ball location, e.g. in the neighborhood of three feet.

The extent of flexure of wall 37 is controlled by the rotational motion of knob 46 and the pitch of the threads on screw 42. Micrometer markings on knob 46 and the rear wall of head 35 indicate the target distances obtained with different knob rotational adjustments. Various intermediate knob positions can be achieved.

Figure 11:
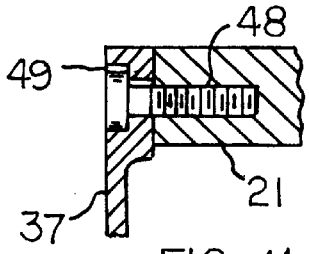
FIG. 11 is a fragmentary enlarged sectional view of a structural detail that can be employed in the golf putters depicted in FIGS. 3 and 9.

During flexure of wall 37 toward the FIG. 4 configuration the wall tends to pull the edge walls 19 and 21 of head element 35 slightly toward ball-striker axis 18. To remove this pulling force, wall 37 can have a sliding connection on the front surfaces of edge walls 19 and 21, as shown in FIG. 11. As there shown, the toe end of wall 37 is joined to wall 21 of head element 35 by one or more screws 48 threaded into threaded hole(s) in wall 21. Each screw extends through a slot 49 in wall 37, such that wall 37 can slide on the front edge of wall 21, to relieve any stress that might otherwise exist between walls 37 and 21. The screw slot connection depicted in FIG. 11 can be duplicated at the joint between wall 37 and wall 19 of head element 35.

Figure 9:
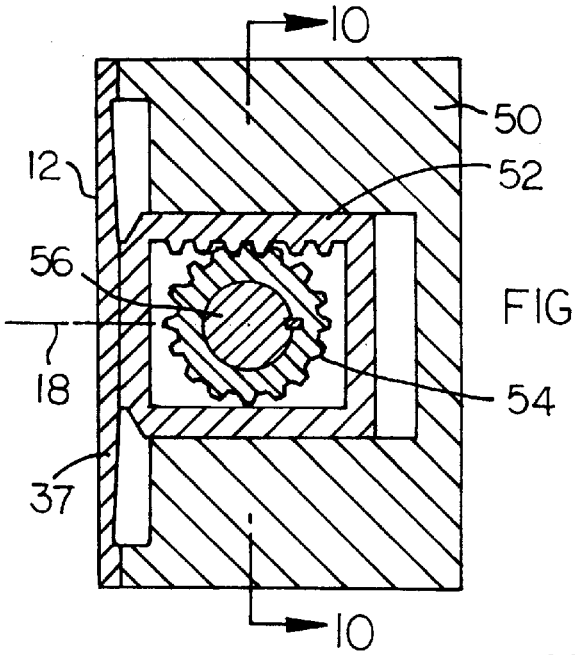
FIG. 9 is a sectional view taken through a further embodiment of the invention.
Figure 10:
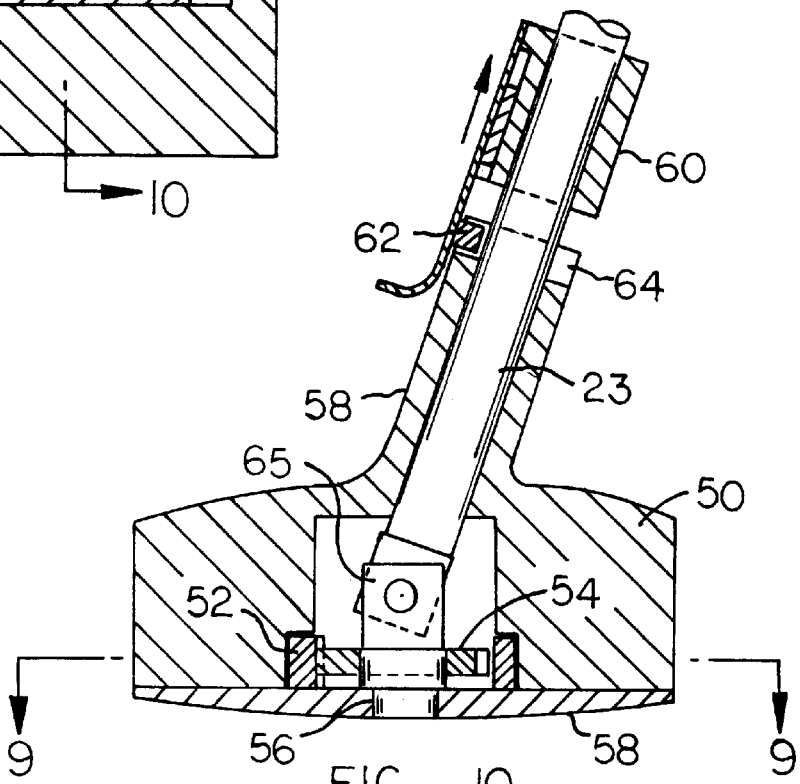
FIG. 10 is a sectional view taken on line 10—10 in FIG. 9.

FIGS. 9 and 10 show a further form that the invention can take. In this case, the flexible wall 37 is flexed from the flat (linear) condition of FIG. 9 toward a concave surface condition (not shown) by means of a toothed rack and pinion mechanism located within a slideway formed in putter head element 50.

Toothed rack 52 is affixed to the rear (interior) surface of flexible wall 37 so as to be slidable on an associated slideway. The associated pinion 54 is affixed to a shaft 56 that is rotatably mounted in a sole plate 58 that forms part of putter head element 50.

Club shaft 23 has a rotary fit in a hosel 58 that extends upwardly from putter head element 50. A collar 60 is affixed to shaft 23 to support a manual detent 62 that is adapted for insertion into selected notches 64 in the upper edge of hosel 58. Detent 62 is used for locking shaft 23 in selected positions of rotary adjustment relative to hosel 58.

Shaft 23 is operatively connected to shaft 56 by means of a universal joint 65 located within a cavity in putter head element 50. When detent 62 is retracted, shaft 23 can be manually rotated to impart rotational motion to shaft 56. Pinion gear 54 is rotated to slide rack 52 along the ball-striker axis 18, thereby flexing wall 37 to vary the contour of ball-striking surface 12. The variation in contour can be similar to the contour variations depicted in FIGS. 3 and 4.

In the FIG. 9 construction the ends of flexible wall 37 can be connected to putter head element 50 by means of slidable stress-relief joints, as depicted in FIG. 11. Detent 62 holds the club shaft 23 in selected positions of rotary adjustment in hosel 58. Micrometer markings on the hosel can be used to identify the target distance for each adjusted position of shaft 23.

The drawings show various forms that the invention can take. FIG. 2 shows a putter club head having an arcuate negatively contoured ball-striking surface 12, according to the invention. FIGS. 5 through 8 show a putter head assembly, wherein interchangeable inserts can be attached to a club head element, to provide a range of differently contoured ball-striker surfaces, according to the invention. FIGS. 3 and 4 show a further embodiment of the invention, wherein the putter club head has a flexible front wall 37 that can be flexed by a manual screw, to provide a range of differently contoured ball-striker surfaces. As shown in FIGS. 9 and 10, the adjusting mechanism comprises a universal joint for transmitting a rotational force from the club shaft to a pinion gear 54; the pinion gear adjusts the position of a toothed rack that is attached to flexible wall 37.

It will be appreciated that the invention can be practiced in various forms and configurations.

What is claimed:

1. A golf putter comprising:

a putter head having a concave ball-striking surface symmetrical around a ball-striker axis, so that when said surface strikes a golf ball at points offset from said axis the ball is caused to roll toward a target point located along the ball-striker axis;

said ball-striking surface comprising a flexible front wall on said putter head; and means for varying the curvature of said ball-striking surface; said curvature-varying means comprising a manual adjustment mechanism operable to exert flexural forces on said flexible front wall.

2. A golf putter comprising:

a putter head having a ball-striking surface that has a heel edge and a toe edge, and a ball-striker axis located approximately midway between said edges;

said ball-striking surface being contoured so that when the putter head is swung along any path parallel to the ball-striker axis the golf ball will roll toward a target point located on said axis, even when the ball is struck at a point offset from said axis; and means for adjusting the contour of said ball-striking surface between a flat contour normal to the ball-striker axis and a concave contour symmetrical around the ball-striker axis, to thereby vary the target point location along said axis;

said ball-striking surface comprising a flexible ball-striker wall; said contour adjusting means comprising a mechanism for flexing said ball-striker wall so that the contour of said ball-striking surface can be varied between a flat contour normal to the ball striker axis and various concave contours symmetrical around the ball-striker axis.

3. The golf putter of claim 2, wherein said flexing mechanism comprises a screw in said putter head operable to exert a pulling force on said flexible wall.

4. The golf putter of claim 3, wherein said screw is located on said ball-striker axis.

5. The golf putter of claim 4, wherein said flexing mechanism further comprises a manual knob carried by said screw for rotating said screw around the screw axis.

6. The golf putter of claim 2, wherein said flexing mechanism comprises a rack-and-pinion means operable to exert a pulling force on said flexible wall.

7. The golf putter of claim 6, wherein said rack-and-pinion means comprises a pinion gear mounted for rotation in said putter head, and a toothed rack attached to said flexible wall, whereby pinion gear rotation moves said rack along the ball-striker axis.

8. The golf putter of claim 6, wherein said flexing mechanism further includes a golf club shaft rotatably connected to said putter head, and means responsive to manual rotation of said shaft for operating said rack-and-pinion means.

9. The golf putter of claim 8, wherein said rotation-responsive means comprises a universal joint located in said putter head.

10. A golf putter comprising:

a putter head having a non-deformable ball-striking surface that has a heel edge and a toe edge, and a ball-striker axis located approximately midway between said edges;

said ball-striking surface being contoured so that when the putter head is swung along any path parallel to the ball-striker axis the golf ball will roll toward a target point located on said axis, even when the ball is struck at a point offset from said axis; and means for adjusting the stable non-transitory contour of said ball-striking surface between a flat contour normal to the ball-striker axis and a concave contour symmetrical around the ball-striker axis, to thereby vary the target point location along said axis.

* * * * *